US005638640A

United States Patent [19]

Harbeck et al.

[11] Patent Number: 5,638,640

[45] Date of Patent: Jun. 17, 1997

[54] SAFETY DEVICE FOR SPRING-LOADED OVERHEAD DOORS

[75] Inventors: Wayne D. Harbeck, Bloomingdale; Dale V. Hecker, Itasca, both of Ill.

[73] Assignee: Wayde D. Harbeck, Bloomingdale, Ill.

[21] Appl. No.: 536,774

[22] Filed: Sep. 29, 1995

[51] Int. Cl.[6] ..... E05F 3/18; E05D 13/00

[52] U.S. Cl. ..... 49/322; 49/200

[58] Field of Search ..... 49/197, 199, 200, 49/322; 160/189, 190, 191, 192, 315, 318, 306; 267/175, 176, 177, 179

[56] References Cited

U.S. PATENT DOCUMENTS

| | | | |
|---|---|---|---|
| 1,992,006 | 2/1935 | Greegor | 49/179 |
| 2,758,836 | 8/1956 | Purdy | 49/179 |
| 3,038,535 | 6/1962 | Stroup et al. | 160/191 |
| 3,615,065 | 10/1971 | Elliott | 160/191 |
| 3,685,847 | 8/1972 | Smolka et al. | 267/177 |
| 4,981,165 | 1/1991 | Miller et al. | 160/191 |

*Primary Examiner*—Kenneth J. Dorner
*Assistant Examiner*—Curtis A. Cohen
*Attorney, Agent, or Firm*—Cesari and McKenna

[57] ABSTRACT

A safety device for engagement to the rotary shaft of a spring-loaded overhead door assembly so as to cover an adjustable end of the coil spring which imparts counterbalancing torque to the shaft. The safety device includes a cup-like sheath having a generally cylindrical side wall and an end wall having an axial opening therein. A tubular sleeve extends from the end wall around the opening and a threaded passage is present in the sleeve. A threaded fastener is threaded into the passage, the fastener being recessed in the passage and having a head whose outer surface is uninterrupted except for a plurality of spaced-apart small holes whereby the fastener can only be rotated by a tool which is sized to fit in said passage and which has a plurality of prongs which register with said holes.

4 Claims, 1 Drawing Sheet

SAFETY DEVICE FOR SPRING-LOADED OVERHEAD DOORS

FIELD OF THE INVENTION

This invention relates to a spring-loaded overhead door of the type used to close an opening into a garage or other building. It relates more particularly to a safety device for preventing an unauthorized person from gaining access to and re-adjusting the spring tensioning mechanism that normally counterbalances the door.

BACKGROUND OF THE INVENTION

A typical overhead door assembly comprises a door composed of panels connected together by horizontal hinges. The individual door panels may roll on tracks at the opposite sides of the door opening, there being suitable small roller carriages interconnecting the panels and the tracks. The door and tracks are arranged so that when the door is closed it fits tightly around the door opening.

The door assembly also includes a mechanism to facilitate opening and closing the door. Usually this mechanism employs a horizontal shaft which is rotatably mounted above the door opening. Pulleys are present adjacent to the opposite ends of the shaft around which are wound cables. Corresponding first ends of these cables are connected to the corresponding pulleys. The opposite ends of those cables are secured to opposite sides of the lowest panel of the door.

Such door assemblies also invariably include means for counterbalancing the weight of the door. In many popular overhead door assemblies, the counterbalancing means comprise one or more springs coiled around the shaft. One end of each spring is fixed, while the other end of each spring is secured to the shaft for rotation therewith. The spring(s) impart a torque to the shaft and pulleys thereon which tension the cables sufficiently to almost offset the weight of the door so that the door can be opened and closed easily by a small upward or downward pulling force on the door. Usually, a short strap or rope is provided at the side of the lowest door panel to facilitate opening and closing the door.

In all overhead door installations, the spring bias provided by the counterbalancing spring(s) is set during installation by adjusting one end of each spring so that the total spring bias just offsets the weight of the original door. In such cases, it has been found that the counterbalance becomes upset over time so that more or less force is required to open or close the door. This upset may be due to aging of the counterbalancing spring(s) or to added door weight, such as when the door is painted, etc. As a result, over time, the door may not close completely or may slam closed.

Sometimes people are tempted to adjust the counterbalancing mechanism so that the door will close correctly. This raises the possibility that an inexperienced, unauthorized and/or non-technical person could become injured in the process of making the tension adjustment. In other words, when fully wound up or loaded, the counterbalancing spring (s), each of which may be several feet long, possess considerable potential energy. Therefore, if one end of the counterbalancing spring(s) should be released suddenly, the spring(s) would instantly unwind causing possible injury to an unknowledgeable homeowner or other servicer.

SUMMARY OF THE INVENTION

To avoid the above problem, we have designed a safety device that blocks access to the adjustable ends of the torsion springs. The safety device covers the adjustable end of each torsion spring and is secured in place with special screws that require a special tool for removal. Only authorized, experienced, overhead door technicians will have the special tool in their possession to loosen and move the safety device to make adjustments to the torsion spring(s). When the adjustments are completed, the technician will shift the safety device back in place over the adjustable end of the torsion spring(s) and re-secure the special screws.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
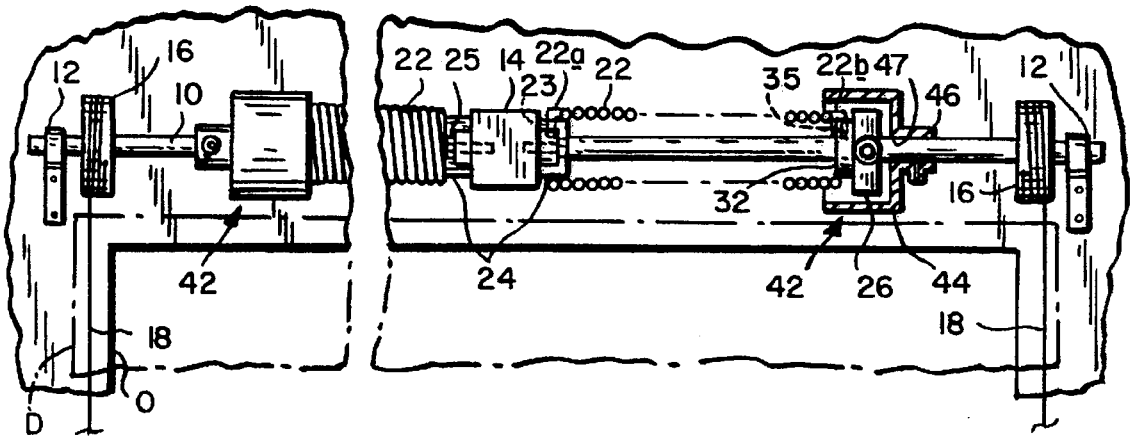
FIG. 1 is a front elevational view with parts broken away showing our safety device incorporated into an overhead garage door assembly.

Referring to FIG. 1 of the drawings, our overhead door assembly comprises a shaft 10 which is rotatably supported horizontally above a door opening O by a pair of pillow blocks or bearings 12 at the opposite ends of the shaft. Usually also there is another bearing support 14 located at the middle of the shaft. Mounted to shaft 10 just inboard the ends of the shaft is a pair of multiple groove pulleys 16. A cable 18 is wound around each pulley 16, the adjacent or upper end of each cable 18 being fixed to the corresponding pulley. The opposite or lower end of each cable 18 is secured to the lower edge of a door D sized to cover the opening O. Typically, door D is composed of a plurality of door panels which are horizontally hinged together. When the door D is raised or lowered, the various door panels are guided by suitable tracks (not shown) mounted adjacent to the side edges of the door opening O. Appropriate door panels and tracks are shown, for example, in U.S. Pat. No. 1,857,756, the contents of which are hereby incorporated herein by reference.

In order to counterbalance the weight of door D, the door assembly includes at least one coil spring 22 encircling shaft 10. These springs may have various diameters and lengths depending upon the weight of the particular door D in the assembly. The illustrated assembly has two such springs 22 each one being about 3 inches in diameter and 2–3 feet long. The inboard end **22*a* of each spring 22 is secured to a collar 24 which encircles shaft 10. For example, the end 22*a* of the spring 22 may hook into a hole 23 formed in the collar. Each collar 24 is, in turn, fastened to the bearing support 14 by threaded fasteners 25. Thus, the inboard ends of springs 22** are fixed.

Figure 2:
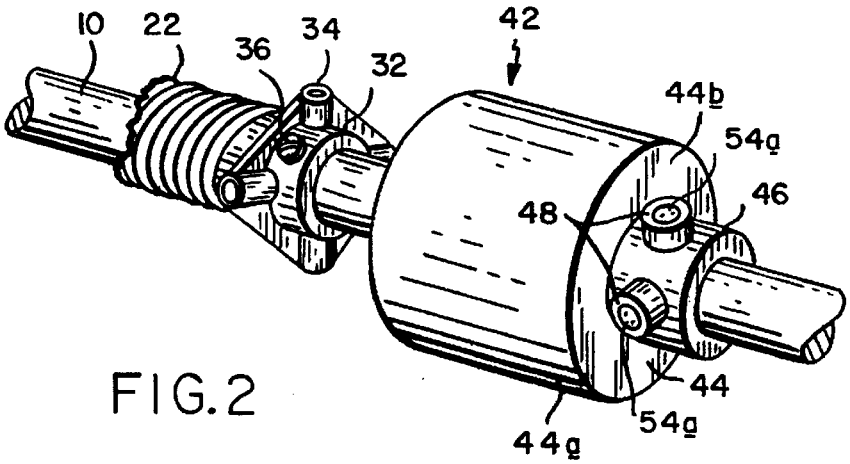
FIG. 2 is a fragmentary isometric view on a larger scale showing a portion of the FIG. 1 assembly in greater detail and with the safety device in its retracted or exposing position.

Referring to FIGS. 1 and 2, the outboard end **22*b* of each spring 22 is secured to a tension-adjusting cone or spider 26 which is releasably secured to shaft 10. In the illustrated assembly, each spider 26 includes a ring 32 snugly encircling shaft 10. The inboard end 22*b* of each spring 22 is bent radially inward and hooked into a hole 35 in the associated ring 32. Each spider 26 also has a plurality, herein four, tubular arms 34 which extend radially out from ring 32**.

These arms facilitate winding up the associated spring 22 in order to adjust the spring tension. More specifically, a screwdriver or other such tool may be inserted into one or another of the arms 34 to facilitate rotating the spider 26 about shaft 10 in order to wind up the associated spring 22. Each spider 26 also includes one or more set screws 36 (FIG. 2) that may be threaded radially into ring 32 so as to bear against shaft 10.

In order to counterbalance the weight of door D, the spiders 26 may be rotated about shaft 10 so as to wind up the springs 22, following which the screws 36 may be tightened against the shaft 10 so as to fix the positions of the spiders 26 and thus the spring ends **22*b*. The springs should be wound up to such an extent that, collectively, they impart a torque to shaft 10 that tensions the cables 18** to a degree that almost offsets the present weight of the door D. The door D can then be raised and lowered manually with minimum effort.

It will be appreciated from the foregoing that when wound up, each spring 22 posseses a considerable amount of potential energy. Thus, if a spider 26 should be released from shaft 10, the spider would spin about the shaft and the adjacent end of the associated spring may fly out away from the spider and possibly cause injury. To avoid this potential problem, the present door assembly also includes a safety device 42 at the adjustable end of each spring 22.

As best seen in FIGS. 1 and 2, each device 42 comprises a cup-like shroud 44 that is sized to encircle the associated spider 26 and spring end **22*b* affixed thereto. Each shroud 44 has a generally cylindrical side wall 44*a* and an outboard end wall 44*b*. A tubular sleeve 46 extends axially from wall 44*b* with the sleeve being sized to snugly but slidably engage around shaft 10. A similarly sized hole 47 (FIG. 1) is present in end wall 44*b* at the base of sleeve 46. Extending out radially from collar 46 is a plurality, herein two, internally threaded collars 48 and a hole 52 (FIG. 3) is provided in sleeve 46 at the base or root of each collar 48. Each collar threadedly receives a set screw 54 whose inner end is arranged to engage shaft 10 through hole 52 in order to fix the position of the safety device 42 on shaft 10**.

Figure 3:
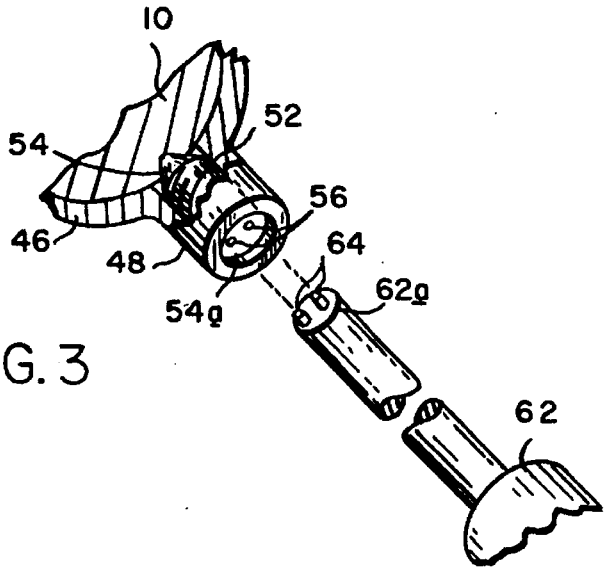
FIG. 3 is a similar view on a still larger scale illustrating the means for fixing the position of the safety device.

Preferably, the screw 54 is not a standard screw. Rather, as shown in FIG. 3, it is a pan head screw whose head **54*a* has a plurality, herein two, small tool-receiving holes 56. Moreover, screw head 54*a* is recessed into the associated collar 48 so that in order to turn the screw, a special tool 62 is required having a special cylindrical shank end 62*a* whose diameter is slightly less than the inner diameter of collar 48. Tool 62 also has a plurality of prongs 64 projecting out from the working end of the shank. These prongs are dimensioned and spaced apart so that they can fit in the holes 56 in the set screw heads 54*a***.

After the spring tensions have been set as described above, the safety devices 42 are slid inwardly along shaft 10 from the FIG. 3 position so as to cover the adjustable ends **22*b* of springs 22 as shown in FIG. 1. Then, the positions of the devices are fixed by tightening the set screws 54 using tool 62. When secured thusly, the safety device prevents the casual loosening of the set screws 36 that fix the positions of the tensioning-adjusting spiders 26. Thus, the safety devices 42 prevent an unknowledgeable homeowner or other person from suddenly releasing the potential energy stored in springs 22**.

When it does become necessary to adjust the tensions of springs 22 because of spring aging or because the load on the springs has changed over time, e.g., due to painting of door D, the tension adjustment can only be carried out by a person in possession of the special tool 62. That person may simply insert the working end of the tool into the collars 48 and loosen screws 54. Each safety device 42 may then be slid outward toward an end of shaft 10 so as to expose the associated spider 26. Obviously, the distance between each pulley 16 and the adjacent spider 26 should be large enough to permit such movement.

The safety devices 42 are preferably molded of a suitable inexpensive rugged, weather-resistant material, such as high density polyethylene, so that cost can be kept to a minimum. The devices 42 may be molded in several sizes to accomodate the range of spring diameters described above.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be considered illustrative and not in a limiting sense.

It is also to be understood that the following claims are intended to cover all of the generic and specific features of the invention described herein.

What is claimed is:

1. In combination, a safety device and a spring-loaded door assembly that closes a door opening in a structure, said assembly being of the type including a door movable vertically relative to the structure so as to expose or cover the door opening, a horizontal shaft adapted to be rotatably mounted to the structure above the door opening, tensioning means operative between the door and the shaft for moving the door vertically when the shaft is rotated, at least one coil spring, each spring having opposite ends and encircling a shaft, means for fixing one end of each spring so that the spring one end remains stationary, said safety device including winding means for securement to the other end of each spring and for engagement to the shaft for winding the other end of each spring about the shaft so that said at least one coil spring exerts a total spring torque on the shaft to substantially counterbalance the weight of the door at the time of the adjustment, said winding means comprising a spider, said spider including a ring sized to engage around the shaft, at least one tubular arm extending out from the ring for engagement by a winding tool to facilitate rotation of the spider about the shaft, securing means for releasably securing each winding means to the shaft to releasably fix the position of the other end of each spring relative to the shaft, said securing means including at least one set screw for threaded engagement in said ring so as to bear against said shaft, and cover means removably covering the securing means, each cover means comprising a cup-like shroud having a generally cylindrical side wall and an end wall, said side wall being sized to encircle the associated spider and set screw therein, means defining an axial opening in said end wall, a tubular sleeve extending out axially from the end wall and surrounding said opening, said opening and said sleeve being sized to snugly receive said shaft and fixing means for adjustably fixing the position of the cover means on the shaft.

2. The combination defined in claim 1 wherein said fixing means include a threaded passage in said sleeve, and a threaded fastener for threaded engagement in said passage so as to bear against said shaft, said fastener being recessed into said passage and having a head with an uninterrupted outer surface except for a plurality of spaced-apart small holes which are accessible only by a tool that fits in said passage and has projections spaced and sized to engage in said holes in order to turn the fastener.

3. In combination, a safety device and a spring-loaded door assembly that closes a door opening in a structure, said assembly being of the type including a door movable vertically relative to the structure so as to expose or cover the door opening, a horizontal shaft adapted to be rotatably mounted to the structure above the door opening, tensioning means operative between the door and the shaft for moving the door vertically when the shaft is rotated, at least one coil spring, each spring having opposite ends and encircling the shaft, means for fixing one end of each spring so that the spring one end remains stationary, said safety device including winding means for securement to the other end of each spring and for engagement to the shaft for winding the other end of each spring about the shaft so that said at least one coil spring exerts a total spring torque on the shaft to substantially counterbalance the weight of the door at the time of the adjustment, securing means for releasably securing each winding means to the shaft to releasably fix the position of the other end of each spring relative to the shaft and cover means removably covering the securing means, said cover means including a cup-like shroud having a generally cylindrical sidewall and an end wall, said sidewall being sized to encircle the associated securing means, means defining an axial opening in said end wall, a tubular sleeve extending out axially from the end wall and surrounding said opening, said opening and said sleeve being sized to snugly receive said shaft, and fixing means for adjustably fixing the position of the cover means on the shaft.

4. The combination defined in claim 3 wherein the winding means comprise a spider, said spider including a ring sized to snugly engage around the shaft, at least one tubular arm extending out from the ring for engagement by a winding tool to facilitate rotation of the spider about the shaft, and the securing means include at least one set screw for threaded engagement in said ring so as to bear against the shaft.

* * * * *